US010354821B2

(12) United States Patent
Sakuyama et al.

(10) Patent No.: US 10,354,821 B2
(45) Date of Patent: Jul. 16, 2019

(54) GAS CIRCUIT BREAKER

(71) Applicant: Hitachi, Ltd., Tokyo (JP)

(72) Inventors: Toshiaki Sakuyama, Tokyo (JP); Ryoichi Shiobara, Tokyo (JP); Hajime Urai, Tokyo (JP); Makoto Hirose, Tokyo (JP); Masanao Terada, Tokyo (JP); Takahiro Nishimura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/900,822

(22) Filed: Feb. 21, 2018

(65) Prior Publication Data

US 2018/0277323 A1 Sep. 27, 2018

(30) Foreign Application Priority Data

Mar. 24, 2017 (JP) ..... 2017-058393

(51) Int. Cl.
*H01H 33/90* (2006.01)
*H01H 33/82* (2006.01)
(Continued)

(52) U.S. Cl.
CPC ..... *H01H 33/901* (2013.01); *H01H 33/53* (2013.01); *H01H 33/82* (2013.01);
(Continued)

(58) Field of Classification Search
CPC .... H01H 33/53; H01H 33/7084; H01H 33/82; H01H 33/901; H01H 33/902; H01H 33/905; H01H 2033/906; H01H 33/08
(Continued)

(56) References Cited

U.S. PATENT DOCUMENTS 3,988,554 A * 10/1976 Graf ..... H01H 33/901 218/64
4,798,924 A * 1/1989 Ackermann ..... H01H 33/7023 218/43

(Continued)

FOREIGN PATENT DOCUMENTS

JP 02-129822 A 5/1990
KR 1020120035869 * 4/2012 ..... H01H 33/901

OTHER PUBLICATIONS

Translation KR 10-2012-0035869 (Original published Apr. 16, 2012) (Year: 2012).*

*Primary Examiner* — Edwin A. Leon
*Assistant Examiner* — William A Bolton
(74) *Attorney, Agent, or Firm* — Mattingly & Malur, PC

(57) ABSTRACT

To provide a gas circuit breaker designed to achieve further improvement in interruption performance for a small to medium current. The gas circuit breaker according to the present invention includes: an operation mechanism 1; a heat puffer chamber 19; a machine puffer chamber 32; a release valve 34; a movable main contact 5 and movable arc contact 11; a stationary main contact 6 and stationary arc contact 12; a movable-side leading conductor 14; and a stationary-side leading conductor 15, and features: a separation cylinder 21 for radially partitioning the heat puffer chamber 19; an inner circumferential flow path 24 formed on an inner circumferential side of the separation cylinder 21; and a check valve 22 for opening or closing a communication hole 23.

5 Claims, 9 Drawing Sheets

(51) Int. Cl.
*H01H 33/53* (2006.01)
*H01H 33/70* (2006.01)
*H01H 71/14* (2006.01)

(52) U.S. Cl.
CPC ... *H01H 33/7084* (2013.01); *H01H 2033/902* (2013.01); *H01H 2033/906* (2013.01); *H01H 2033/908* (2013.01); *H01H 2071/147* (2013.01)

(58) Field of Classification Search
USPC ..... 218/49, 51, 53, 57, 59–61
See application file for complete search history.

(56) References Cited

U.S. PATENT DOCUMENTS 5,898,149 A * 4/1999 Berger ..... H01H 33/904 218/60
5,977,502 A * 11/1999 Mizoguchi ..... H01H 33/901 218/43
7,763,821 B2 * 7/2010 Yoshitomo ..... H01H 33/88 218/57
8,030,590 B2 * 10/2011 Yoshida ..... H01H 33/905 218/57
9,058,947 B2 * 6/2015 Yaginuma ..... H01H 33/08

* cited by examiner

GAS CIRCUIT BREAKER

TECHNICAL FIELD

The present invention relates to a puffer type gas circuit breaker. Particularly, the present invention relates to a gas circuit breaker utilizing heating and pressure rising effect by arc heat.

BACKGROUND ART

The gas circuit breaker is used in an electric power system for interrupting a fault current occurring due to interphase short circuit, ground fault or the like. Heretofore, the puffer type gas circuit breakers have been used widely. In this puffer type gas circuit breaker, a high-pressure gas flow is generated by mechanically compressing an arc-extinguishing gas by means of a movable puffer cylinder directly connected to a movable arc contact. The resultant gas flow is blown onto an arc generated between the movable arc contact and a stationary arc contact so that an electric current is interrupted.

The current interruption performance of the gas circuit breaker is dependent on pressure buildup in a puffer chamber. In this connection, a heat puffer combination type gas circuit breaker adapted for pressure buildup by active use of the heat energy of arc as well as for hitherto known pressure buildup based on mechanical compression is also used extensively. The heat puffer combination type gas circuit breaker utilizes the heat energy of arc for generating a pressure for applying a blast of arc-extinguishing gas. As compared with the conventional device based on mechanical compression, this type of gas circuit breaker can reduce operational energy required for interruption operation.

On the other hand, the heat energy of arc is proportional to the fault current. In the interruption of a large current, the arc has such large heat energy as to generate a high pressure. In the interruption of a small to medium current, however, the arc heat provides a small pressure buildup. Therefore, the pressure generated by mechanical compression is used for blowing the arc-extinguishing gas onto the arc so as to interrupt the electric current.

Patent Literature 1 discloses a puffer type gas circuit breaker which includes: a heat gas chamber formed in the puffer chamber; a separator substantially shaped like a cylinder and disposed between an insulation nozzle and a movable arcing contact; a first release path for guiding an insulation gas from the heat gas chamber to a vicinity of a through hole (arc space); and a second release path for guiding the insulation gas from the puffer chamber to the vicinity of the through hole.

CITATION LIST

Patent Literature

Patent Literature 1: Japanese Unexamined Patent Application Publication No. Hei2(1990)-129822

SUMMARY OF INVENTION

Technical Problem

According to the patent literature 1, the high temperature gas supplied from the heat gas chamber and the gas at relatively low temperature supplied from the puffer chamber are each directly guided into the arc space. Hence, a high-temperature gas portion providing a starting point of dielectric breakdown, which is detrimental to the interruption of a small to medium current, is directly blown into the arc space. This leads to a fear of deterioration of the current interruption performance as a result of the dielectric breakdown. The puffer type gas circuit breaker of this patent literature is faced with a problem of improving the current interruption performance in a small to medium current region where the pressure buildup by the heat gas is small.

The present invention has been accomplished in view of the above problem, and an object thereof is to provide a heat puffer combination type gas circuit breaker which is further improved in the current interruption performance in the small to medium current region.

Solution to Problem

According to an aspect of the present invention for achieving the above object, a gas circuit breaker includes: a cylindrical movable-side main conductor supportively fixed by an insulation cylinder disposed in a gas-filled envelope containing an insulation gas having an arc-extinguishing property, connected to a movable-side leading conductor connected to an electric power system, and including an exhaust hole for exhausting a high temperature and pressure gas as the insulation gas raised in temperature and pressure by a generated arc; a hollow exhaust shaft disposed in the movable-side main conductor and movable in an axial direction of the movable-side main conductor; an operation mechanism coupled to the exhaust shaft and outputting a force operating in an axial direction of the exhaust shaft; a cylinder coaxially coupled to the exhaust shaft and axially slidable on an inside surface of the movable-side main conductor, a piston coupled to the cylinder, an insulation nozzle coupled to the piston, and a heat puffer chamber enclosed by the cylinder; a blast-gas flow path communicating the heat puffer chamber and an arc space, and defined by a gap between the insulation nozzle and a movable element cover; a puffer piston fixed to the inside of the movable-side main conductor, and including an opening which is opened in the axial direction of the movable-side main conductor and whose inside surface allows the exhaust shaft to slide thereon; a hole communicating a movable-side conductor inner circumferential space defined on the operation mechanism side as seen from the puffer piston and a machine puffer chamber formed on the opposite side from the operation mechanism; a release valve for releasing the insulation gas from the machine puffer chamber into the movable-side conductor inner circumferential space when the machine puffer chamber is compressed by the exhaust shaft and the cylinder axially moved by the operation mechanism; a movable contact electrically connected to the movable-side leading conductor; and a contact which is electrically connected to a stationary-side leading conductor connected to the electric power system and is in contactable/separable relation with the movable contact, the gas circuit breaker featuring: a separation cylinder disposed in a manner to radially partition the heat puffer chamber; an inner circumferential flow path defined by the separation cylinder on an inner circumferential side of the heat puffer chamber; and a straightening mechanism for opening or closing a communication hole communicating the inner circumferential flow path and the machine puffer chamber.

Advantageous Effects of Invention

According to the present invention, the gas circuit breaker improved in the current interruption performance for a small to medium current is provided which is adapted to blow the arc-extinguishing gas from the machine puffer chamber onto the arc without allowing the arc-extinguishing gas to flow through the heat puffer chamber.

DESCRIPTION OF EMBODIMENTS

Figure 1:
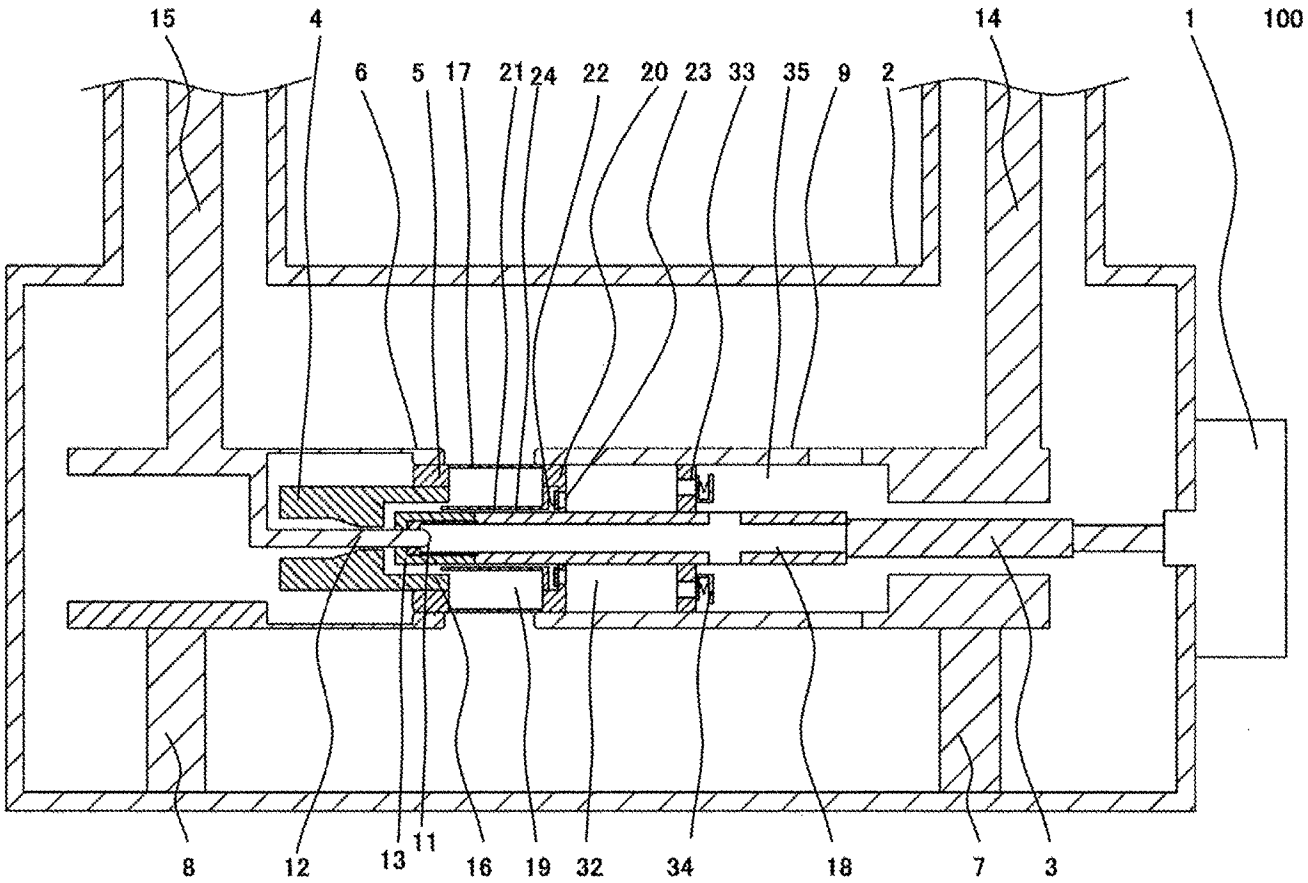
FIG. 1 is a schematic axial sectional view of a gas circuit breaker according to Example 1 hereof.

While the examples of the present invention will hereinbelow be described with reference to the accompanying drawings as needed, the present invention is not limited to the following examples. In the drawings referred to herein, some of the members may not be illustrated for the sake of simplicity. In the following description of the examples, like reference characters refer to the corresponding components, the detailed description of which is dispensed with.

Example 1

FIG. 1 is a schematic axial sectional view of a gas circuit breaker 100 according to Example 1 hereof. It is noted that the term "axial" used herein means a direction of the center axis of a cylinder constituting a movable-side main conductor 9 (the fore-aft direction as seen in FIG. 1) and hereinafter the term "axial" means the same unless otherwise designated. The gas circuit breaker 100 of Example 1 is installed at some midpoint of the electric power system (such as a high voltage circuit). The gas circuit breaker is operative to interrupt current conduction of the electric power system by electrically disconnecting the electric power system in the event of a fault current due to lightning strike.

The gas circuit breaker 100 shown in FIG. 1 includes: the movable-side main conductor 9, an exhaust shaft 18, a cylinder 17, a puffer piston 33, and a release valve 34. These components are accommodated in a gas-filled envelope 2 containing an insulation gas having an arc-extinguishing property (such as sulfur hexafluoride). Disposed forwardly of the exhaust shaft 18 are a movable main contact 5 and a movable arc contact 11 (both are movable contacts). These components are electrically connected to a movable-side leading conductor 14 connected to the electric power system. A stationary main contact 6 and a stationary arc contact 12 in contactable/separable relation with the movable main contact 5 and the movable arc contact 11 are supportively fixed in position by a stationary-side insulation cylinder 8 and are electrically connected to a stationary-side leading conductor 15 connected to the electric power system. In the event of the above-described fault current, therefore, the current conduction of the electric power system is interrupted by separating the movable main contact 5 and the movable arc contact 11 from the stationary main contact 6 and a stationary arc contact 12.

The exhaust shaft 18 is coupled with an operation mechanism 1 for outputting an operation force in the axial direction of the exhaust shaft 18. Referring to FIG. 1, the operation mechanism 1 is coupled to the exhaust shaft 18 via an operation rod 3. In the event of a fault current or the like, a moving command from an unillustrated output portion is inputted to the operation mechanism 1. In response to this moving command, the operation mechanism 1 moves the exhaust shaft 18 rearward by means of the operation rod 3 whereby the movable main contact 5 and the movable arc contact 11 are separated from the stationary main contact 6 and the stationary arc contact 12. Thus, the electric power system is shut off.

The cylinder 17 is coupled to the exhaust shaft 18 in a coaxial relation with the exhaust shaft 18. In conjunction with the axial movement of the exhaust shaft 18, the cylinder 17 is slidably movable in the movable-side main conductor 9 shaped like a cylinder. A piston 20 is disposed rearward of the cylinder 17. A machine puffer chamber 32 is formed in the movable-side main conductor 9, as interposed between the piston 20 and the puffer piston 33 (to be described herein later). Therefore, the insulation gas in the machine puffer chamber 32 is compressed by the cylinder 17 moved rearward along with the exhaust shaft 18. The movable-side main conductor 9 is supported by a movable-side insulation cylinder 7.

The movable main contact 5 is mounted to a forward end of the cylinder 17. On the other hand, the movable arc contact 11 is mounted to a forward end of the exhaust shaft 18 in a manner to be surrounded by this movable main contact 5. This movable arc contact 11 is faced to the interior of exhaust shaft 18 and is covered with a movable element cover 13. An insulation nozzle 4 is mounted to the forward end of the cylinder 17 in a manner to enclose the movable arc contact 11 and the stationary arc contact 12. A blast-gas flow path 16 communicating an arc space 31 and a heat puffer chamber 19 is defined between the insulation nozzle 4 and the movable element cover 13.

The heat puffer chamber 19 is formed in the cylinder 17 forward of the piston 20. A high temperature and pressure gas generated by the arc is fed into the heat puffer chamber 19, the details of which will be described herein later. This heat puffer chamber 19 is radially partitioned by a separation cylinder 21 so that an inner circumferential flow path 24 is formed between the separation cylinder 21 and the exhaust shaft 18 along with the movable element cover 13. The arc space 31 and the above-described machine puffer chamber 32 are communicated with each other via the blast-gas flow path 16, the inner circumferential flow path 24 and a communication hole 23. A flow of the insulation gas will be described herein later with reference to FIG. 2, FIG. 3 and the like.

A disk-like check valve 22 is disposed in space defined by the separation cylinder 21 and the piston 20 axially opposed to each other. The check valve 22 closes the communication hole 23 when the check valve 22 is shifted to a rightward position on the drawing surface.

The puffer piston 33 is a disk-like element fixed in the movable-side main conductor 9. The puffer piston 33 has an opening (not shown) in the vicinity of the center thereof. The exhaust shaft 18 is inserted through this opening. Thus, the exhaust shaft 18 is allowed to move axially, sliding on an inside peripheral surface of the opening of the fixed puffer piston 33.

A movable-side conductor inner circumferential space 35 is defined in the movable-side main conductor 9 and rearward of the puffer piston 33. Further, the machine puffer chamber 32 is formed in the movable-side main conductor 9 and forward of the puffer piston 33, as described above. The puffer piston 33 is formed with a hole 36 configured to surround the exhaust shaft 18 and to communicate the movable-side conductor inner circumferential space 35 and the machine puffer chamber 32.

The release valve 34 is adapted to release the insulation gas in the machine puffer chamber 32 into the movable-side conductor inner circumferential space 35 when the machine puffer chamber 32 is compressed by the operation mechanism 1 operating to move the exhaust shaft 18, the cylinder 17 and the piston 20 rearward in the axial direction. The release valve 34 is spring loaded against the puffer piston 33 so as to close the hole 36. The release valve 34 is opened when the internal pressure of the machine puffer chamber 32 being compressed exceeds the spring force. Thus, the insulation gas in the machine puffer chamber 32 is released into the movable-side conductor inner circumferential space 35.

Figure 2:
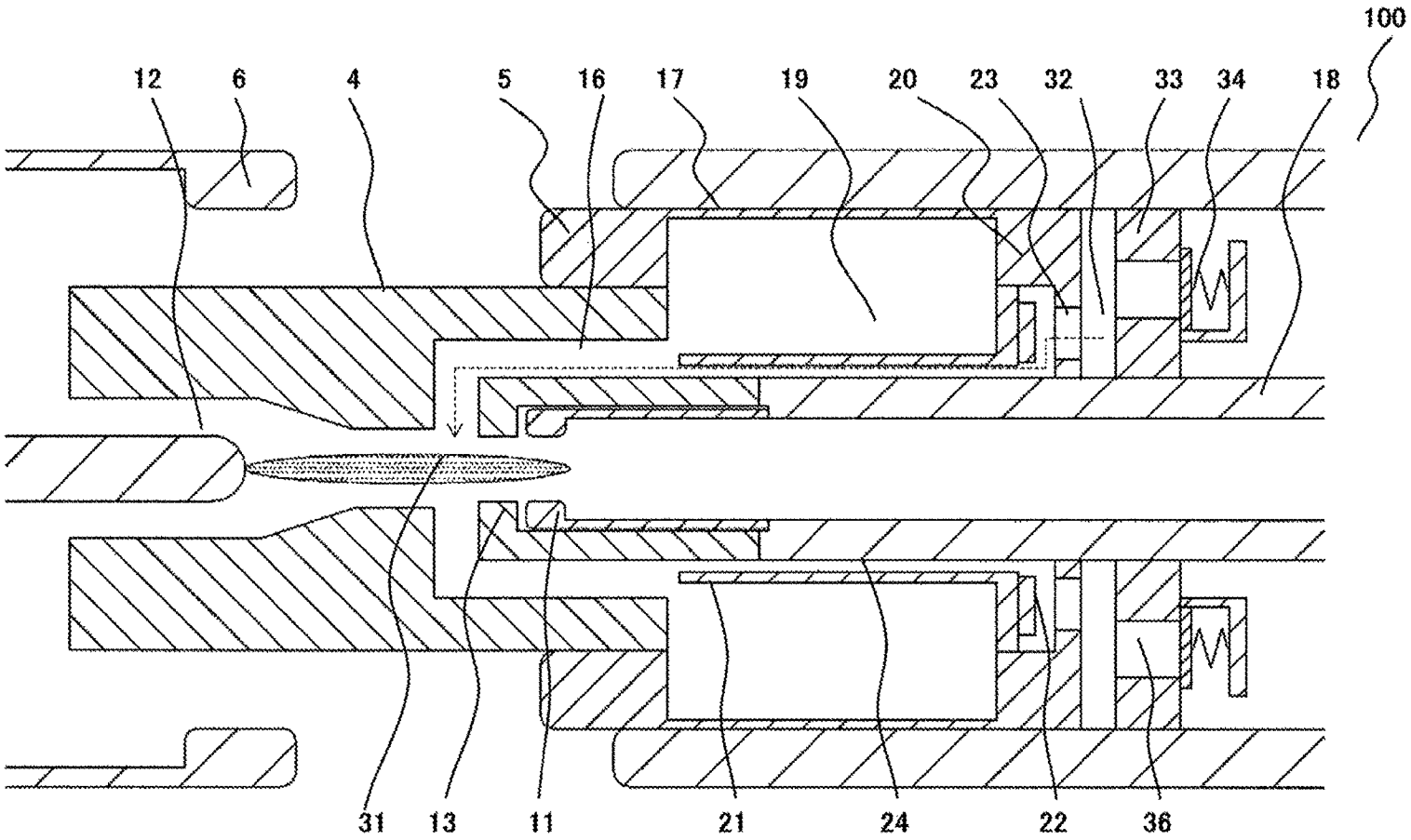
FIG. 2 is a schematic diagram showing a gas flow in the gas circuit breaker of Example 1 during the interruption of a small to medium current.
Figure 3:
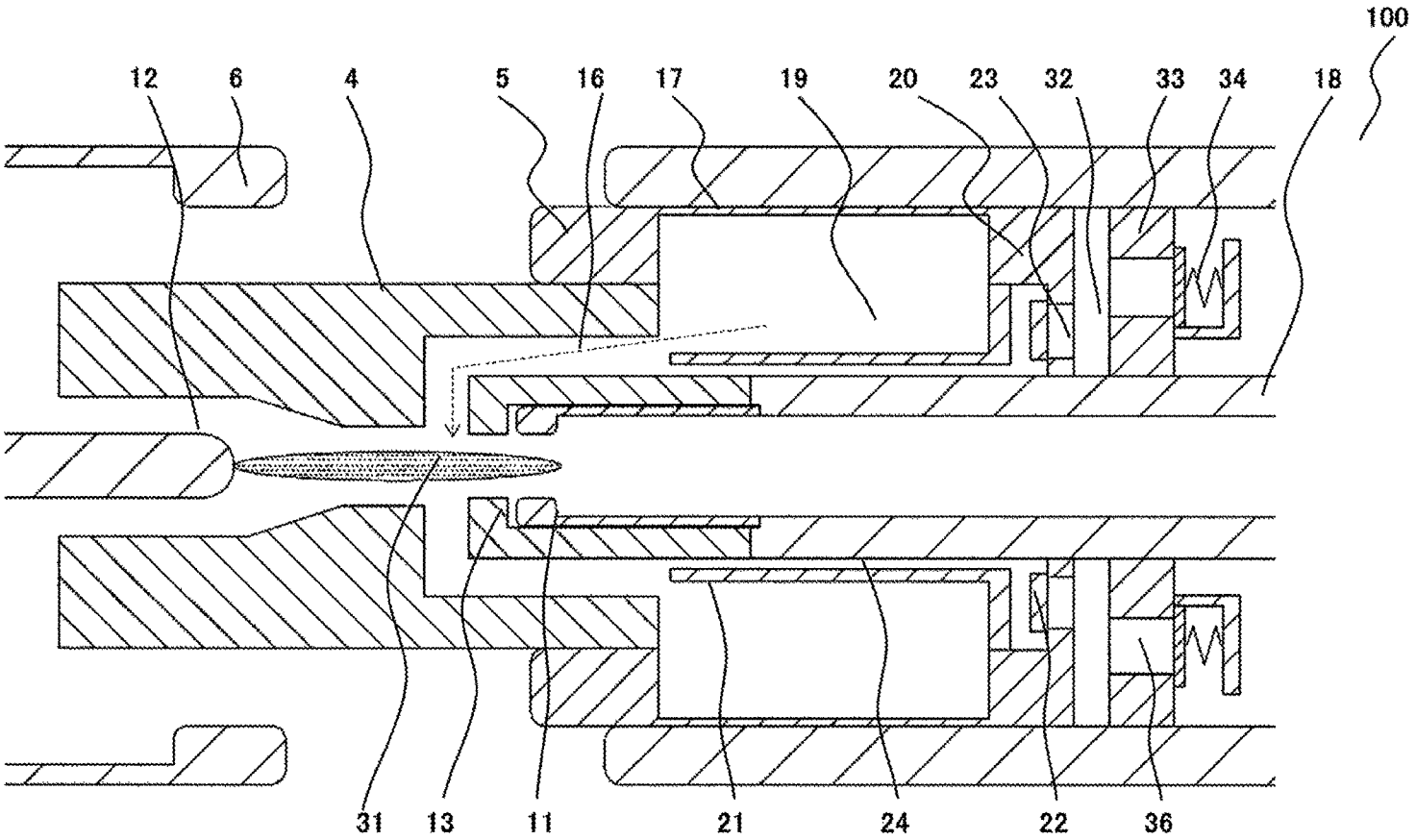
FIG. 3 is a schematic diagram showing a gas flow in the gas circuit breaker of Example 1 during the interruption of a large current.

FIG. 2 and FIG. 3 are schematic diagrams showing a gas flow in the gas circuit breaker 100 of Example 1 during the interruption of a small to medium current, and a gas flow in the gas circuit breaker 100 of Example 1 during the interruption of a large current, respectively. In the event of a fault current or the like, the operation mechanism 1 moves the exhaust shaft 18 rearward by means of the operation rod 3, as described above. Thus, the cylinder 17 (including the piston 20, separation cylinder 21, check valve 22, communication hole 23, and inner circumferential flow path 24) integrally formed with the exhaust shaft 18, the movable main contact 5, the movable arc contact 11, the movable element cover 13, and the insulation nozzle 4 are also moved rearward. Accordingly, the movable main contact 5 is separated from the stationary main contact 6 (namely, an interruption operation is performed) so that the gas circuit breaker is shifted to a state to interrupt the current conduction of the electric power system or an open contact state shown in FIG. 2.

When the movable arc contact 11 is separated from the stationary arc contact 12 to place the circuit breaker in the open contact state, arc occurs between the movable arc contact 11 and the stationary arc contact 12 in the insulation nozzle 4, as described above. This arc occurs in the arc space 31 shown in FIG. 2. The insulation gas in the vicinity of the arc space 31 is heated by the arc generated in the arc space 31 and raised in pressure. Some of the insulation gas (high temperature and pressure gas) raised in temperature and pressure in the arc space 31 is guided through the blast-gas flow path 16 into the heat puffer chamber 19 formed in the cylinder 17.

A flow of a blast gas during the interruption of a small to medium current is described as below with reference to FIG. 2. The interruption operation drives the cylinder 17 and the like so that the machine puffer chamber 32 is compressed as described above while the pressure in the machine puffer chamber 32 is raised. During the interruption of a small to medium current, the pressure generated in the arc space 31 is lower than the pressure generated by compressing the machine puffer chamber 32. Hence, the pressures of the blast-gas flow path 16 and the heat puffer chamber 19 are lower than that of the machine puffer chamber 32. Therefore, the check valve 22 between the inner circumferential flow path 24 and the communication hole 23 is moved toward the inner circumferential flow path 24 due to a pressure difference, opening the communication hole 23. The gas compressed in the machine puffer chamber 32 is made to circumvent the heat puffer chamber 19 but is blown into the arc space 31 via the inner circumferential flow path 24 and the blast-gas flow path 16 (indicated by the arrowed dash line in FIG. 2) while circumventing the heat puffer chamber 19.

Next, a flow of the blast gas during the interruption of a large current is described with reference to FIG. 3. During the interruption of a large current, some of the insulation gas (high temperature and pressure gas) raised in temperature and pressure in the arc space 31 is guided through the blast-gas flow path 16 into the heat puffer chamber 19 and inner circumferential flow path 24 formed in the cylinder 17. When the pressure of the inner circumferential flow path 24 is higher than the pressure of the machine puffer chamber 32, the check valve 22 moves toward the communication hole 23 so as to close the communication hole 23, thus preventing the pressure of the machine puffer chamber 32 from being unnecessarily raised. On the other hand, a blast pressure is generated in the heat puffer chamber 19 and applied to the arc space 31 (indicated by the arrowed dash line in FIG. 3).

During the interruption of a small to medium current, as described above, the gas circuit breaker 100 of Example 1 is capable of blowing the gas from the machine puffer chamber 32 into the arc space 31 while circumventing the heat puffer chamber 19. Thus, the gas density of the arc space 31 is increased by blowing the low temperature gas therein. The gas circuit breaker can achieve an improved interruption performance for a small to medium current. Because of having the check valve 22, the gas circuit breaker does not unnecessarily raise the pressure of the machine puffer chamber 32 during the interruption of a large current. This leads to the reduction of influences of interruption operation stagnation or the like.

Example 2

Figure 4:
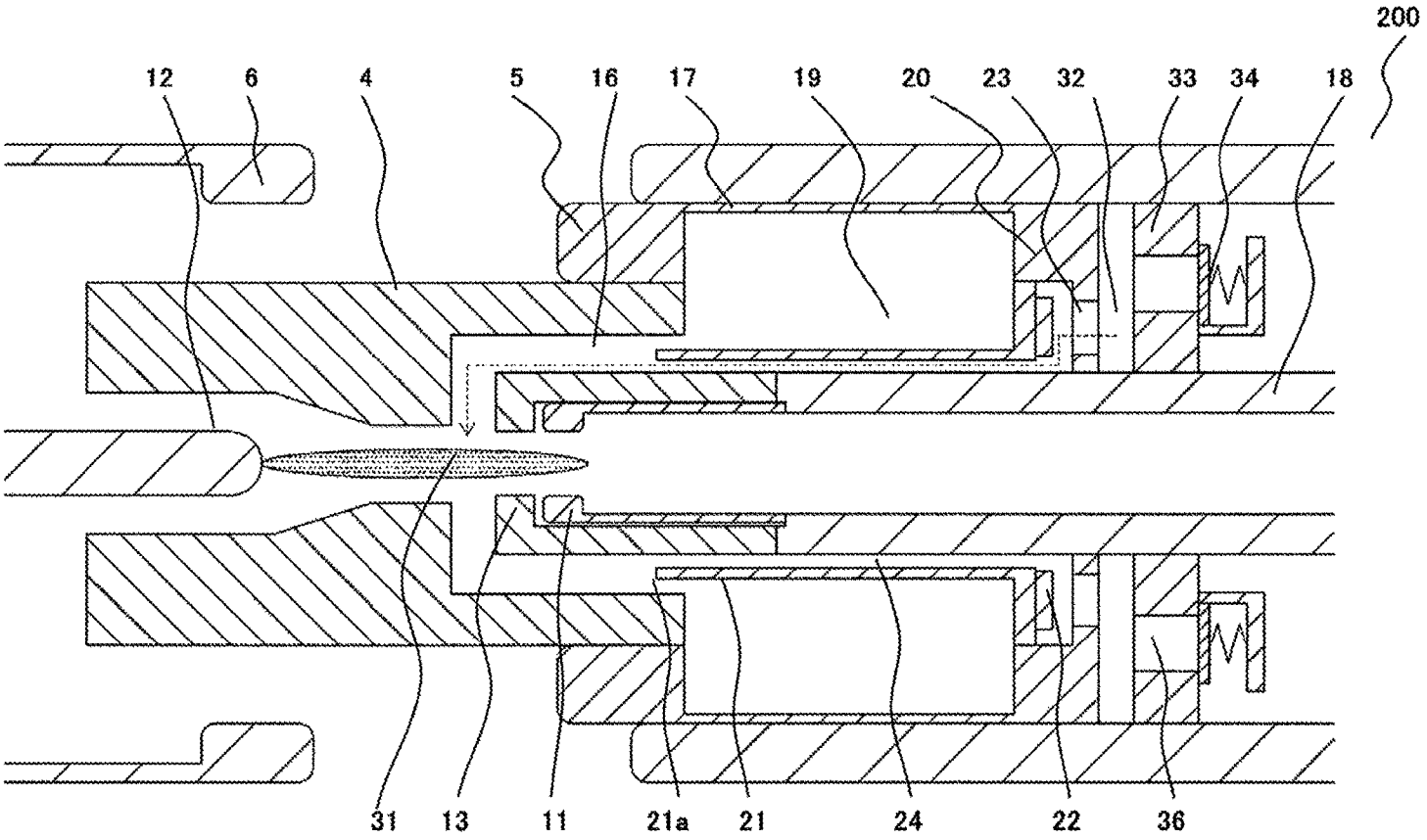
FIG. 4 is a schematic diagram of an axial cross-section about an arc space in a gas circuit breaker according to Example 2 hereof.

FIG. 4 is a schematic diagram of an axial cross-section about the arc space 31 in a gas circuit breaker 200 according to Example 2 hereof. The gas circuit breaker 200 shown in FIG. 4 differs from the gas circuit breaker 100 of Example 1 in that a distal end 21*a* of the separation cylinder 21 is located in the blast-gas flow path 16.

Description is made on the effect of Example 2. In a case where the distal end 21*a* of the separation cylinder 21 is located in the arc space 31, the blast gas flow from the heat puffer chamber 19 and the blast gas flow from the machine puffer chamber 32 are applied to the arc space 31 without being mixed together so that the high temperature gas being blown is likely to produce an origin of dielectric breakdown. According to Example 2, on the other hand, the distal end 21*a* of the separation cylinder 21 is located in the blast-gas flow path 16. Hence, the blast gas flow from the heat puffer chamber 19 and the blast gas flow from the inner circumferential flow path 24 are joined together in the blast-gas flow path 16. Therefore, the high temperature gas flowing in from the heat puffer chamber 19 and the low temperature gas flowing in through the inner circumferential flow path 24 can be mixed together in the blast-gas flow path 16. Thus, the high temperature gas potentially producing the origin of dielectric breakdown is prevented from entering the arc space 31. Since the gas flow from the inner circumferential flow path 24 into the heat puffer chamber 19 can be inhibited, the gas from the machine puffer chamber 32 can be efficiently blown into the arc space 31.

As described above, this example can achieve improved interruption performance for a small to medium current.

Example 3

Figure 5:
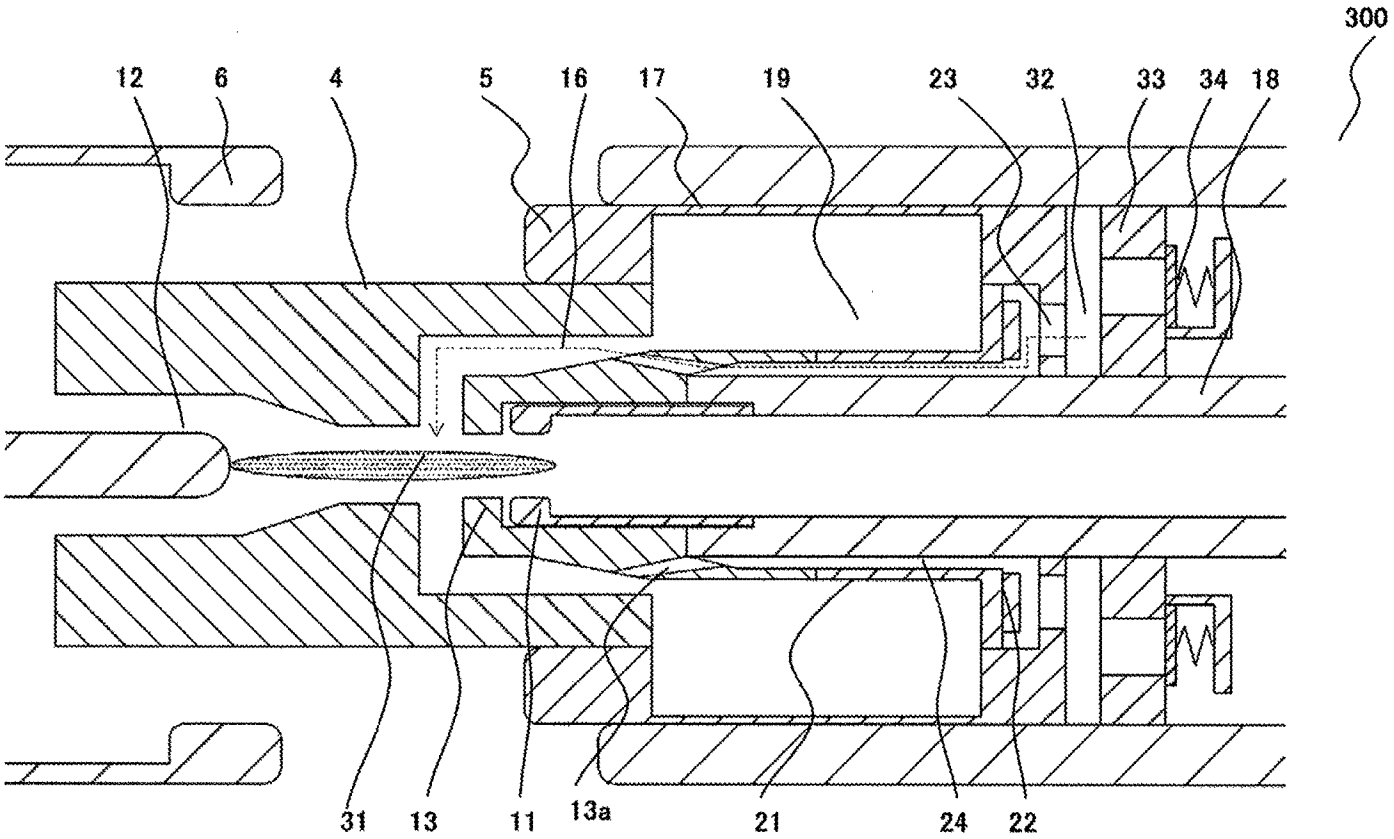
FIG. 5 is a schematic diagram of an axial cross-section about an arc space in a gas circuit breaker according to Example 3 hereof.

FIG. 5 is a schematic diagram of an axial cross-section about the arc space 31 in a gas circuit breaker 300 according to Example 3 hereof. The gas circuit breaker 300 shown in FIG. 5 has a configuration where the movable element cover 13 and the separation cylinder 21 are connected together and where the inner circumferential flow path 24 is defined by the movable element cover 13 and an inside surface of the separation cylinder 21. The movable element cover 13 includes a movable element cover communication hole 13*a* for communicating the inner circumferential flow path 24 and the blast-gas flow path 16.

According to Example 3, the blast gas from the machine puffer chamber 32 is guided into the blast-gas flow path 16 through the communication hole 23, inner circumferential flow path 24, and movable element cover communication hole 13*a*, as indicated by the arrowed dash line in FIG. 5. The blast gas from the heat puffer chamber 19 and the blast gas from the machine puffer chamber 32 are joined and mixed together in the blast-gas flow path 16 so as to prevent the high temperature gas potentially producing the origin of dielectric breakdown from entering the arc space 31. Thus, the example can achieve an improvement in the current interruption performance. Further, the movable element cover 13 employs a polytetrafluoroethylene resin material which is evaporated by contact with arc. The gas generated by the evaporation of the resin material raises the pressure. According to the example, the movable element cover 13 can be configured to extend to the inside of the heat puffer chamber 19. Particularly at the time of interruption of a large current, therefore, the pressure buildup due to the evaporation of the movable element cover 13 on the surface of the heat puffer chamber 19 can be expected. The example can achieve an improvement in interruption performance for a large current as well as interruption performance for a small to medium current.

Example 4

Figure 6:
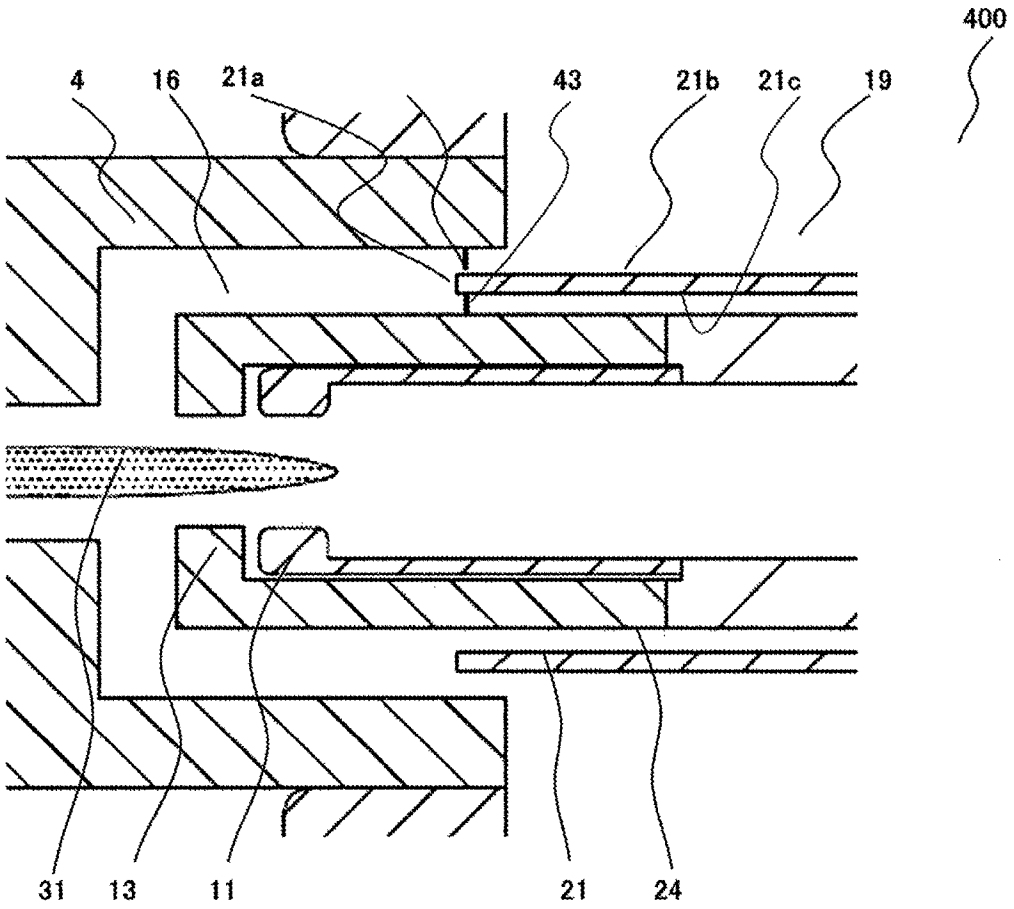
FIG. 6 is an enlarged view of an axial cross-section about an arc space in a gas circuit breaker according to Example 4 hereof.

FIG. 6 is an enlarged view of an axial cross-section about the arc space 31 in a gas circuit breaker 400 according to Example 4 hereof. The gas circuit breaker 400 shown in FIG. 6 differs from the gas circuit breakers of Example 1, Example 2 and Example 3 in that a flow path area 43 is smaller than a flow path area 42. The flow path area 42 is defined at the distal end 21*a* of the separation cylinder 21 and between an outside peripheral surface 21*b* of the separation cylinder 21 and an inlet portion of the heat puffer chamber 19. The flow path area 43 is defined at the distal end 21*a* of the separation cylinder 21 and between an inside peripheral surface 21*c* of the separation cylinder 21 and an outside peripheral surface of the movable element cover 13.

According to the example, the high temperature gas flowing from the arc space 31 into the heat puffer chamber 19 and the inner circumferential flow path 24 through the blast-gas flow path 16 during the current interruption is actively guided into the heat puffer chamber 19 through the flow path of the larger path area or on the outside periphery of the separation cylinder 21 whereby the pressure in the heat puffer chamber 19 can be efficiently built up. As described above, the example can achieve an improvement in interruption performance for a large current as well as interruption performance for a small to medium current.

Example 5

Figure 7:
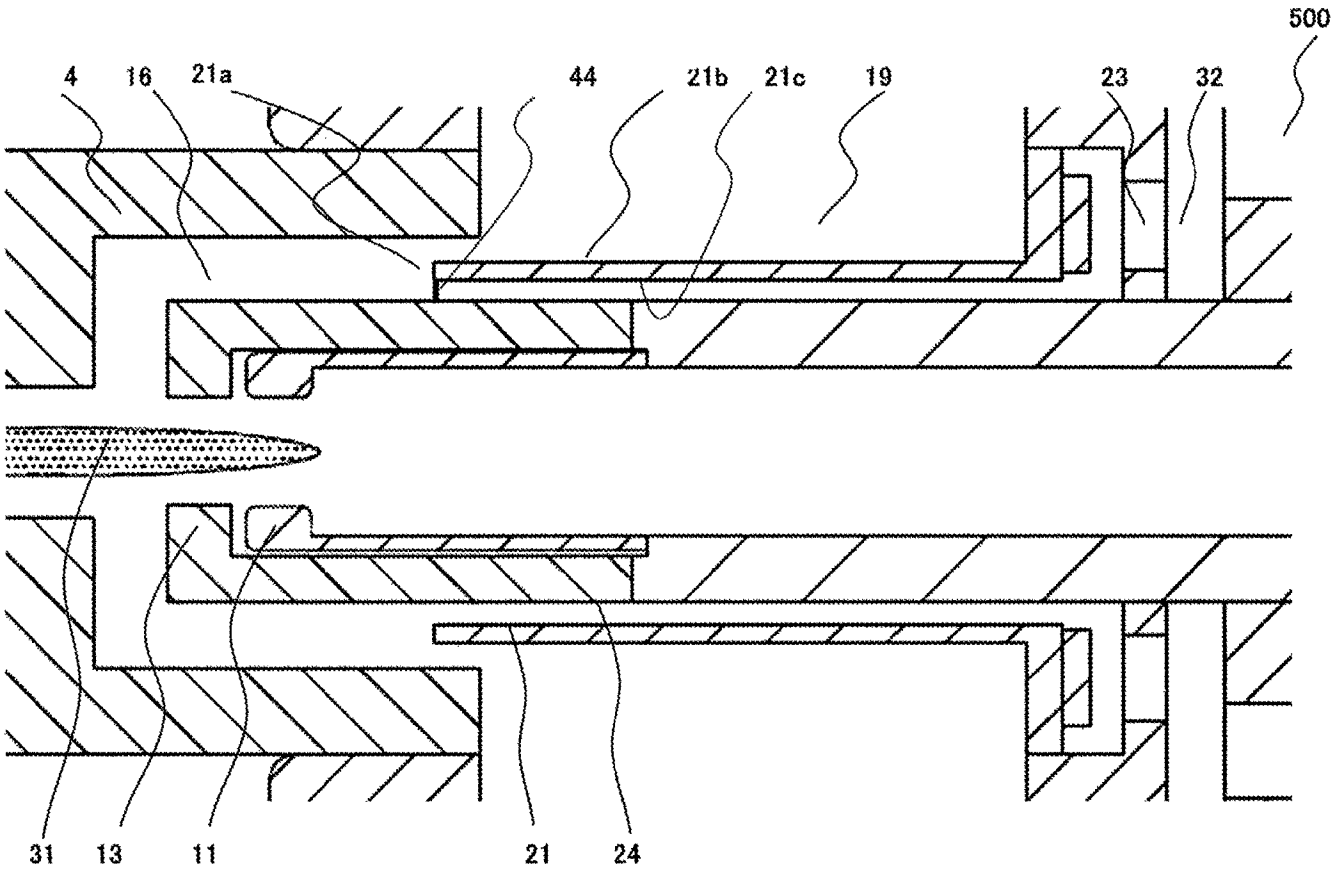
FIG. 7 is an enlarged view of an axial cross-section about an arc space in a gas circuit breaker according to Example 5 hereof.

FIG. 7 is an enlarged view of an axial cross-section about the arc space 31 in a gas circuit breaker 500 according to Example 5 hereof. The gas circuit breaker 500 shown in FIG. 7 differs from the gas circuit breakers of Example 1, Example 2, Example 3 and Example 4 in that a flow path extending from the machine puffer chamber 32 to the distal end 21*a* of the separation cylinder 21 via the communication hole 23 and the inner circumferential flow path 24 has the minimum flow path area 44 defined between the inside peripheral surface 21*c* of the separation cylinder 21 and an outside peripheral surface of the movable element cover 13.

According to the example, the flow of the blast gas from the machine puffer chamber 32 through the communication hole 23 and the inner circumferential flow path 24 can be accelerated when the gas flows through the cross section defining the flow path area 44 during the current interruption. Accordingly, the blast gas from the machine puffer chamber 32 can be blown into the arc space 31 at high speed. The example can achieve an improvement in interruption performance for a small to medium current.

Example 6

Figure 8:
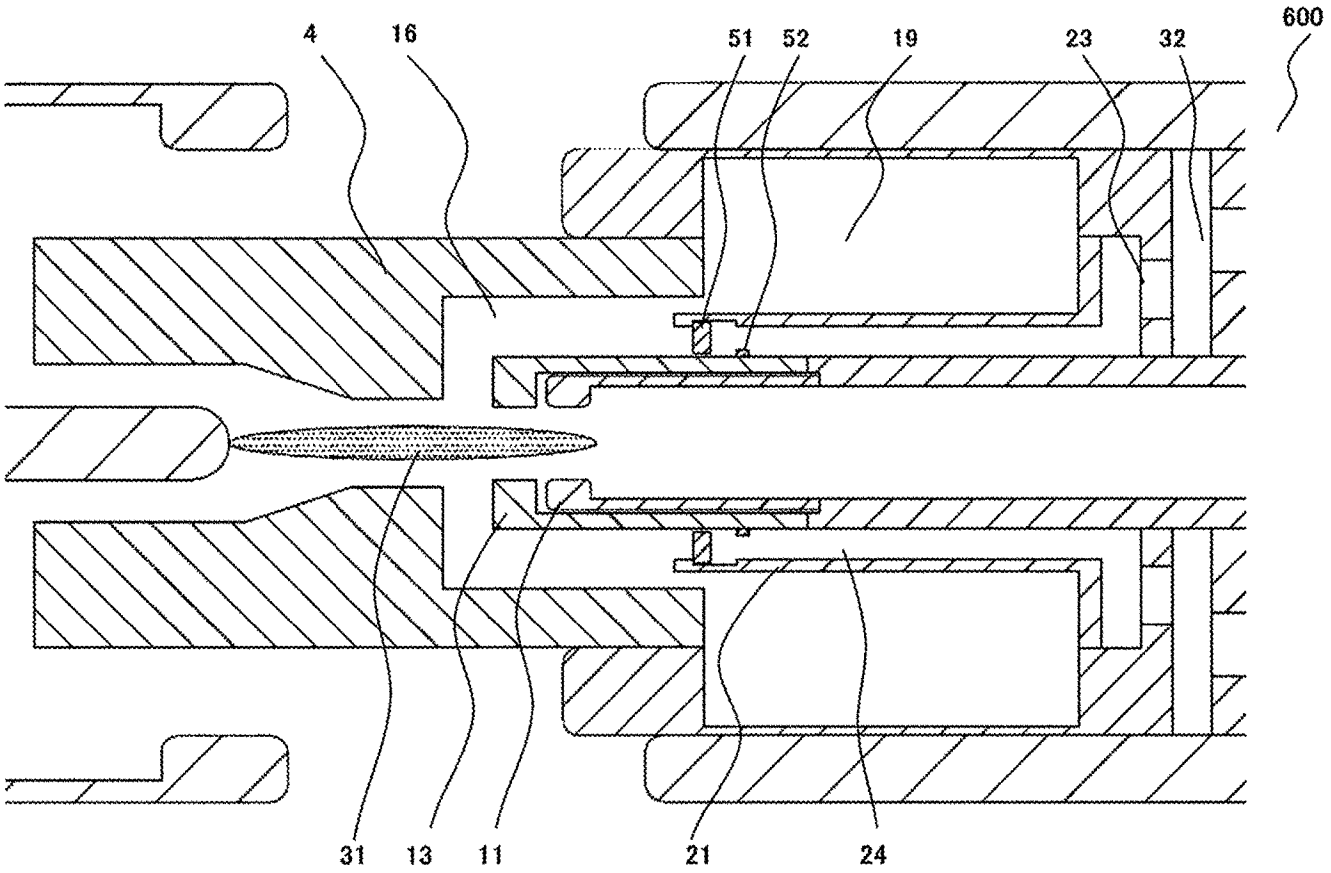
FIG. 8 is an enlarged view of an axial cross-section about an arc space in a gas circuit breaker according to Example 6 hereof.

FIG. 8 is an enlarged view of an axial cross-section about the arc space 31 in a gas circuit breaker 600 according to Example 6 hereof. The gas circuit breaker 600 shown in FIG. 8 differs from the gas circuit breakers of Example 1, Example 2, Example 3, Example 4 and Example 5 in that a disk-like check valve 51 is disposed in the inner circumferential flow path 24 defined between the radial inside surface of the separation cylinder 21 and a radial outside surface of the movable element cover 13 and a radial outside surface of the exhaust shaft 18, that a radial outside surface of the check valve 15 is in face-to-face relation with the radial inside surface of the separation cylinder 21, and that a radial inside surface of the check valve 15 is in face-to-face relation with the radial outside surface of the movable element cover 13 and the radial outside surface of the exhaust shaft 18.

According to Example 6, the high temperature gas flowing from the arc space 31 into the heat puffer chamber 19 through the blast-gas flow path 16 exceeds the pressure of the machine puffer chamber 32 during the interruption of a large current in particular. Because of the pressure difference, the check valve 51 is moved toward the right of the drawing surface and is locked by a locking part 52 and the separation cylinder 21, so as to block the gas flow into the inner circumferential flow path 24. The locking part is disposed from the check valve 51 toward the machine puffer chamber 32. Since the gas flows only into the heat puffer chamber 19, the pressure in the heat puffer chamber 19 can be built up efficiently. During the interruption of a small to medium current, the pressure of the machine puffer chamber 32 exceeds the pressure of the blast-gas flow path 16. Hence, the check valve 51 is moved toward the left of the drawing surface, allowing the blast gas to be blown into the arc space 31 through a flow path defined between an inside periphery of the check valve and the outside periphery of the movable element cover 13 and the outside periphery of the exhaust shaft 18. As described above, the example can achieve an improvement in interruption performance for a large current as well as interruption performance for a small to medium current.

Example 7

Figure 9:
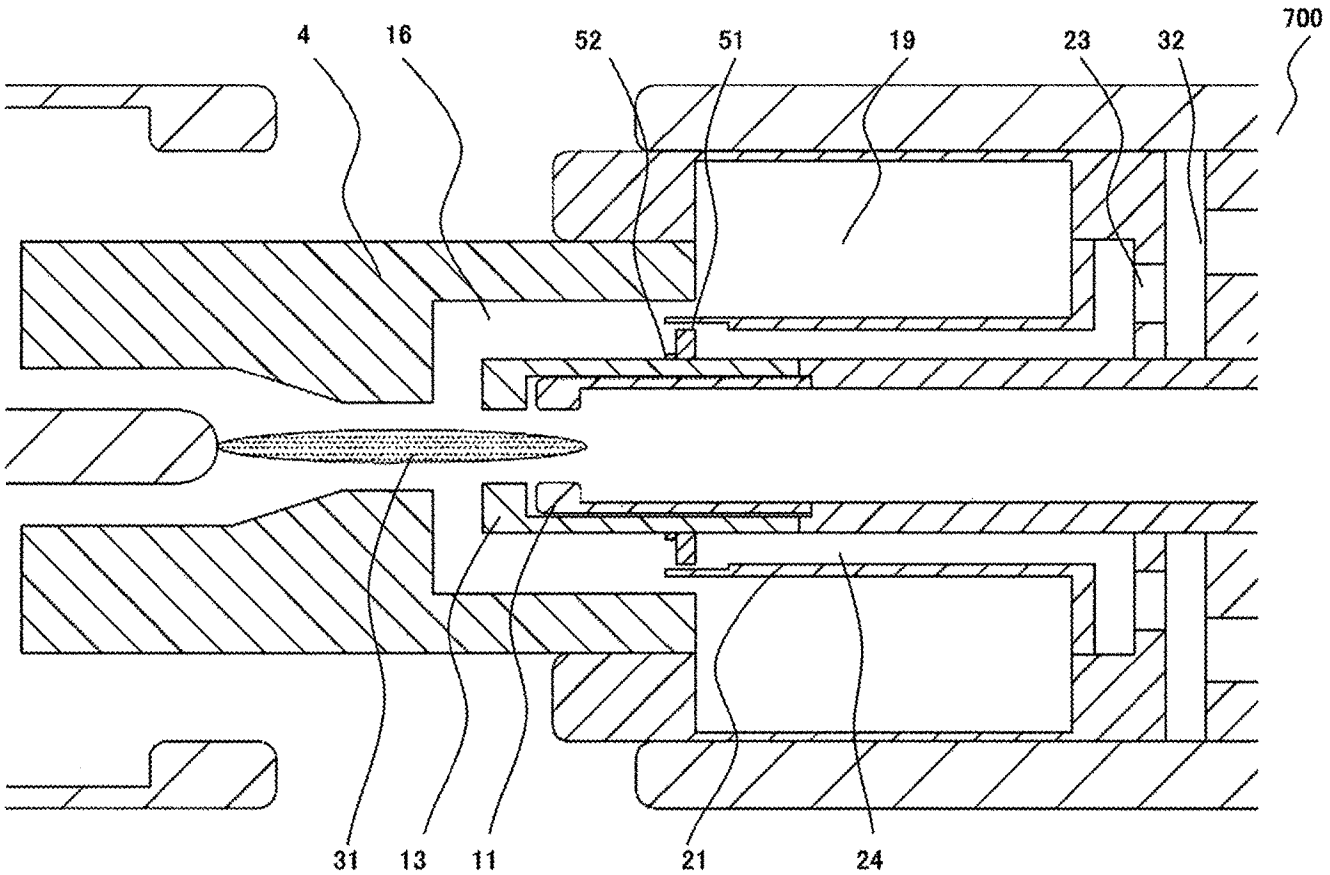
FIG. 9 is an enlarged view of an axial cross-section about an arc space in a gas circuit breaker according to Example 7 hereof.

FIG. 9 is an enlarged view of an axial cross-section about the arc space 31 in a gas circuit breaker 700 according to Example 7 hereof. The gas circuit breaker 700 shown in FIG. 9 differs from the gas circuit breaker of Example 6 in that the locking part 52 is disposed between the check valve 51 and the blast-gas flow path 16 and that a gap defined between the radial inside surface of the separation cylinder 21 and the radial outside surface of the check valve 51 defines a flow path communicating the blast-gas flow path 16 and the inner circumferential flow path 24.

According to Example 7, in interruption performance for a small to medium current, the blast gas flowing from the machine puffer chamber 32 into the arc space 31 passes the radial outside surface of the check valve 51. Hence, the flow path has a larger area than the flow path defined by the radial inside surface, resulting in the reduction of flow path resistance. The example is capable of efficiently blowing the gas into the arc space and achieving an improvement in interruption performance for a small to medium current.

The puffer type gas circuit breaker of the present invention is not limited to the configurations illustrated by the foregoing examples and various changes in the shape, number, size and arrangement of components may be resorted to without departing from the spirit and scope of the present invention. Any of those embodiments can be implemented in combination as needed.

LIST OF REFERENCE SIGNS

1: operation mechanism
2: gas-filled envelope
3: operation rod
4: insulation nozzle
5: movable main contact
6: stationary main contact
7: movable-side insulation cylinder
8: stationary-side insulation cylinder
9: movable-side main conductor
11: movable arc contact
12: stationary arc contact
13: movable element cover
13*a*: movable element cover communication hole
14: movable-side leading conductor
15: stationary-side leading conductor
16: blast-gas flow path
17: cylinder
18: exhaust shaft
19: heat puffer chamber
20: piston
21: separation cylinder
21*a*: distal end of separation cylinder 21
21*b*: outside peripheral surface of separation cylinder 21
21*c*: inside peripheral surface of separation cylinder 21
22: check valve
23: communication hole
24: inner circumferential flow path
31: arc space
32: machine puffer chamber
33: puffer piston
34: release valve
35: movable-side conductor inner circumferential space
36: hole
42: flow path area
43: flow path area
44: flow path area
51: check valve
52: locking part
100,200,300,400,500,600,700: gas circuit breaker

The invention claimed is:

1. A gas circuit breaker comprising:

a cylindrical movable-side main conductor supportively fixed by an insulation cylinder disposed in a gas-filled envelope containing an insulation gas having an arc-extinguishing property, connected to a movable-side leading conductor connected to an electric power system, and including an exhaust hole for exhausting a high temperature and pressure gas as the insulation gas raised in temperature and pressure by a generated arc;

a hollow exhaust shaft disposed in the movable-side main conductor and movable in an axial direction of the movable-side main conductor;

an operation mechanism coupled to the exhaust shaft and outputting a force operating in an axial direction of the exhaust shaft;

a cylinder coaxially coupled to the exhaust shaft and axially slidable on an inside surface of the movable-side main conductor, a piston coupled to the cylinder, an insulation nozzle coupled to the piston, and a heat puffer chamber enclosed by the cylinder;

a blast-gas flow path communicating the heat puffer chamber and an arc space, and defined by a gap between the insulation nozzle and a movable element cover;

a puffer piston fixed to the inside of the movable-side main conductor, and including an opening which is opened in the axial direction of the movable-side main conductor and whose inside surface allows the exhaust shaft to slide thereon;

a hole communicating a movable-side conductor inner circumferential space defined on the operation mechanism side as seen from the puffer piston and a machine puffer chamber formed on the opposite side from the operation mechanism;

a release valve for releasing the insulation gas from the machine puffer chamber into the movable-side conductor inner circumferential space when the machine puffer chamber is compressed by the exhaust shaft and the cylinder axially moved by the operation mechanism;

a movable contact electrically connected to the movable-side leading conductor; and a contact which is electrically connected to a stationary-side leading conductor connected to the electric power system and is in contactable/separable relation with the movable contact, the gas circuit breaker featuring: a separation cylinder disposed in a manner to radially partition the heat puffer chamber; an inner circumferential flow path defined by the separation cylinder on an inner circumferential side of the heat puffer chamber; and a straightening mechanism for opening or closing a communication hole communicating the inner circumferential flow path and the machine puffer chamber, wherein a distal end of the separation cylinder is located in a blast-gas flow path, and wherein the distal end of the separation cylinder is connected to the movable element cover, and the movable element cover includes a movable element cover communication hole for communicating the inner circumferential flow path and the blast-gas flow path.

2. The gas circuit breaker according to claim 1, wherein at the distal end of the separation cylinder, a flow path area defined between an inside peripheral surface of the separation cylinder and an outside peripheral surface of the movable element cover is smaller than a flow path area defined between an outside peripheral surface of the separation cylinder and an inlet portion of the heat puffer chamber.

3. The gas circuit breaker according to claim 2, wherein out of the flow path areas of the flow path extending from the machine puffer chamber through the communication hole and the inner circumferential flow path to the distal end of the separation cylinder, the flow path area of the flow path defined between the inside peripheral surface of the separation cylinder and the outside peripheral surface of the movable element cover is the smallest.

4. The gas circuit breaker according to claim 3, wherein a check valve is disposed in the inner circumferential flow path defined between a radial inside surface of the separation cylinder and a radial outside surface of the movable element cover or between the radial inside surface of the separation cylinder and a radial outside surface of the exhaust shaft, and a radial outside surface of the check valve is in face-to-face relation with the radial inside surface of the separation cylinder while a radial inside surface of the check valve is in face-to-face relation with the radial outside surface of the movable element cover or the radial outside surface of the exhaust shaft.

5. The gas circuit breaker according to claim 3, wherein a locking part for locking the check valve is disposed between the check valve and the blast-gas flow path, and a gap defined between the radial inside surface of the separation cylinder and the radial outside surface of the check valve defines a flow path for communicating the blast-gas flow path and the inner circumferential flow path.

* * * * *